US009997835B2

(12) United States Patent
Tabata et al.

(10) Patent No.: US 9,997,835 B2
(45) Date of Patent: Jun. 12, 2018

(54) BOBBIN FOR BAR ANTENNA AND BAR ANTENNA INCLUDING BOBBIN

(71) Applicant: Aisin Seiki Kabushiki Kaisha, Kariya-shi (JP)

(72) Inventors: Takehiro Tabata, Kariya (JP); Hiroshi Kiriyama, Novi, MI (US); Masashi Tateishi, Nagoya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 48 days.

(21) Appl. No.: 14/861,118

(22) Filed: Sep. 22, 2015

(65) Prior Publication Data

US 2016/0093954 A1 Mar. 31, 2016

(30) Foreign Application Priority Data

Sep. 25, 2014 (JP) ..... 2014-195293

(51) Int. Cl.
*H01Q 1/32* (2006.01)
*H01Q 7/00* (2006.01)
(Continued)

(52) U.S. Cl.
CPC ..... *H01Q 7/08* (2013.01); *H01F 5/02* (2013.01); *H01F 5/04* (2013.01); *H01F 27/24* (2013.01);
(Continued)

(58) Field of Classification Search
CPC .... H01Q 1/3208; H01Q 1/3241; H01Q 1/325; H01Q 1/3283; H01Q 1/12; H01Q 1/14;
(Continued)

(56) References Cited

U.S. PATENT DOCUMENTS 7,598,915 B2 10/2009 Ieda et al.
9,013,262 B2 * 4/2015 Morimoto ..... H01F 5/00 336/190
(Continued)

FOREIGN PATENT DOCUMENTS

DE 101 03 068 C1 8/2002
EP 2 093 833 A1 8/2009
(Continued)

OTHER PUBLICATIONS

Extended European Search Report dated Mar. 4, 2016 in Patent Application No. 15186712.4.

*Primary Examiner* — Tho G Phan
*Assistant Examiner* — Patrick Holecek
(74) *Attorney, Agent, or Firm* — Oblon, McClelland, Maier & Neustadt, L.L.P.

(57) ABSTRACT

A bobbin for a bar antenna includes a core holding portion being configured to be mounted with a stick-shaped core, and a restriction portion being connected to the core holding portion, the restriction portion being configured to restrict a turned-back portion of a conductive wire from moving to a side where a lamination portion is positioned, the conductive wire forming the lamination portion by being wound to the core in a first direction in a longitudinal direction of the core, the turned-back portion serving as a portion being turned back in a second direction that is different from the first direction.

6 Claims, 6 Drawing Sheets

(51) Int. Cl.

| | |
|---|---|
| ***H01F 5/04*** | (2006.01) |
| ***H01Q 7/08*** | (2006.01) |
| ***H01F 27/28*** | (2006.01) |
| ***H01F 27/24*** | (2006.01) |
| ***H01F 27/32*** | (2006.01) |
| ***H01F 5/02*** | (2006.01) |

(52) U.S. Cl.
CPC ..... *H01F 27/2804* (2013.01); *H01F 27/325* (2013.01); *H01Q 1/3241* (2013.01); *H01Q 7/00* (2013.01)

(58) Field of Classification Search
CPC .... H01Q 7/00; H01Q 7/08; H01F 5/02; H01F 5/04; H01F 27/24; H01F 27/2804; H01F 27/324; H01F 27/325
See application file for complete search history.

(56) References Cited

U.S. PATENT DOCUMENTS

| | | | |
|---|---|---|---|
| 9,768,510 | B2 | 9/2017 | Tanaka et al. |
| 2008/0068129 | A1 | 3/2008 | Ieda et al. |
| 2010/0084464 | A1 | 4/2010 | Veillat |

FOREIGN PATENT DOCUMENTS

| | | | | |
|---|---|---|---|---|
| EP | 2093833 | A1 * | 8/2009 | ..... E05B 81/78 |
| JP | 4655230 | | 3/2011 | |
| JP | 2013-128003 | | 6/2013 | |

* cited by examiner

BOBBIN FOR BAR ANTENNA AND BAR ANTENNA INCLUDING BOBBIN

CROSS REFERENCE TO RELATED APPLICATIONS

This application is based on and claims priority under 35 U.S.C. § 119 to Japanese Patent Application 2014-195293, filed on Sep. 25, 2014, the entire content of which is incorporated herein by reference.

TECHNICAL FIELD

This disclosure generally relates to a bobbin for a bar antenna and the bar antenna including the bobbin.

BACKGROUND DISCUSSION

A known system detects that a user is present at a predetermined range of surroundings of a vehicle, or that the user being on the vehicle gets off, by, for example, a communication device communicating with a mobile device that is possessed by the user. In a case where the system detects that the user is present at the predetermined range of the surroundings of the vehicle, the system automatically unlocks a door of the vehicle. In a case where the system detects that the user gets off the vehicle, the system automatically locks the door of the vehicle.

A known bar antenna, which is an example of the communication device of the system, is disclosed in JP4655230B (hereinafter referred to as Patent reference 1). The bar antenna disclosed in Patent reference 1, the bar antenna being mounted to a door handle of the vehicle, serves as a transmission antenna transmitting signals to the mobile device of the user and includes a pair of bobbins that holds respective end portions of a stick-shaped core. A conductive wire is wound around the core that is held by the pair of bobbins to form a coil.

A dimension of the bar antenna in a longitudinal direction can be short by reducing the dimension of the core in the longitudinal direction. Meanwhile, the region of the core around which the conductive wire can be wound is reduced as the length of the core is reduced. Thus, in a case where the length of the core is reduced, the number of windings of the conductive wire is reduced. Accordingly, the inductance desired for the coil may not be secured.

In order to solve this problem, the conductive wire is laminated to be wound around the core, for example. In a case where this solution is applied to the core disclosed in Patent reference 1, a first layer of the conductive wire is wound from a first bobbin that holds the core to a second bobbin that holds the core. Then, the conductive wire is turned back at the second bobbin and a second layer of the conductive line is wound. However, a turned-back portion of the conductive wire is pulled to a side where the first bobbin is positioned in accordance with the winding of the second layer of the conductive wire. Accordingly, an irregular shape of winding of the conductive wire may occur.

A need thus exists for a bobbin for a bar antenna and the bar antenna including the bobbin which is not susceptible to the drawback mentioned above.

SUMMARY

According to an aspect of this disclosure, a bobbin for a bar antenna includes a core holding portion being configured to be mounted with a stick-shaped core, and a restriction portion being connected to the core holding portion, the restriction portion being configured to restrict a turned-back portion of a conductive wire from moving to a side where a lamination portion is positioned, the conductive wire forming the lamination portion by being wound to the core in a first direction in a longitudinal direction of the core, the turned-back portion serving as a portion being turned back in a second direction that is different from the first direction.

A bar antenna includes a stick-shaped core being mounted to the core holding portion, a conductive wire being wound around the core, and a bobbin of the bar antenna including a core holding portion being mounted with the core, and a restriction portion being connected to the core holding portion, the restriction portion restricting a turned-back portion of the conductive wire from moving to a side where a lamination portion is positioned, the conductive wire forming the lamination portion by being wound to the core in a first direction in a longitudinal direction of the core, the turned-back portion serving as a portion being turned back in a second direction that is different from the first direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
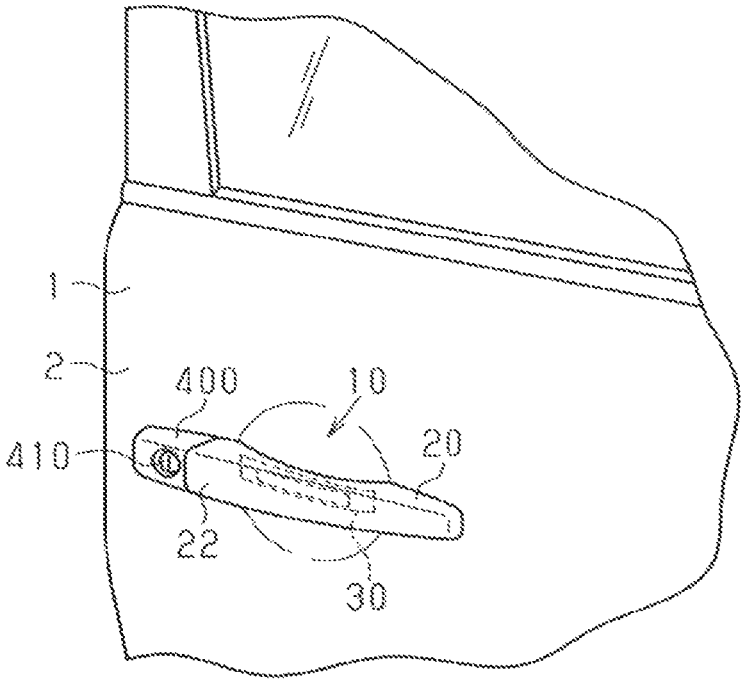
FIG. 1 is a perspective view of a door panel and a door handle of a vehicle according to an embodiment disclosed here.

A structure of a door handle 10 will be explained with reference to FIG. 1. The door handle 10 includes a handle body 20 and a handle cap 400 and is mounted to a door panel 2 of a vehicle 1. The handle body 20 is mounted with a bar antenna 30. The handle cap 400 is formed with the key cylinder 410 into which a key is inserted.

Figure 2:
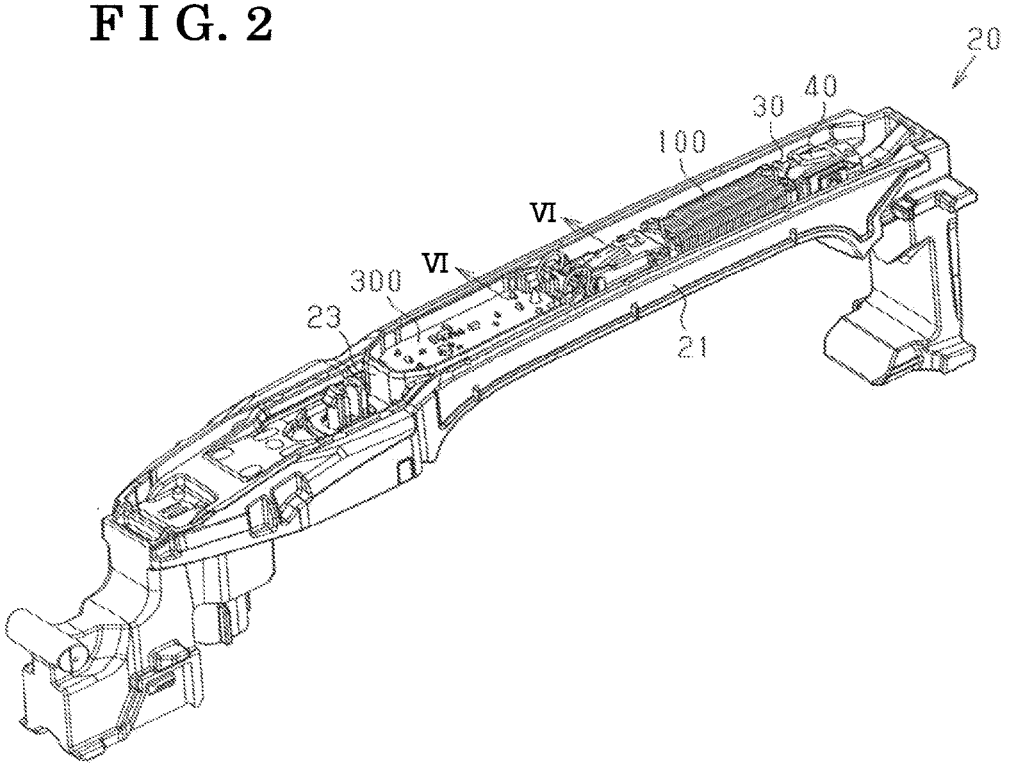
FIG. 2 is a perspective view of the door handle in a state where an exterior case is removed according to the embodiment.
Figure 3:
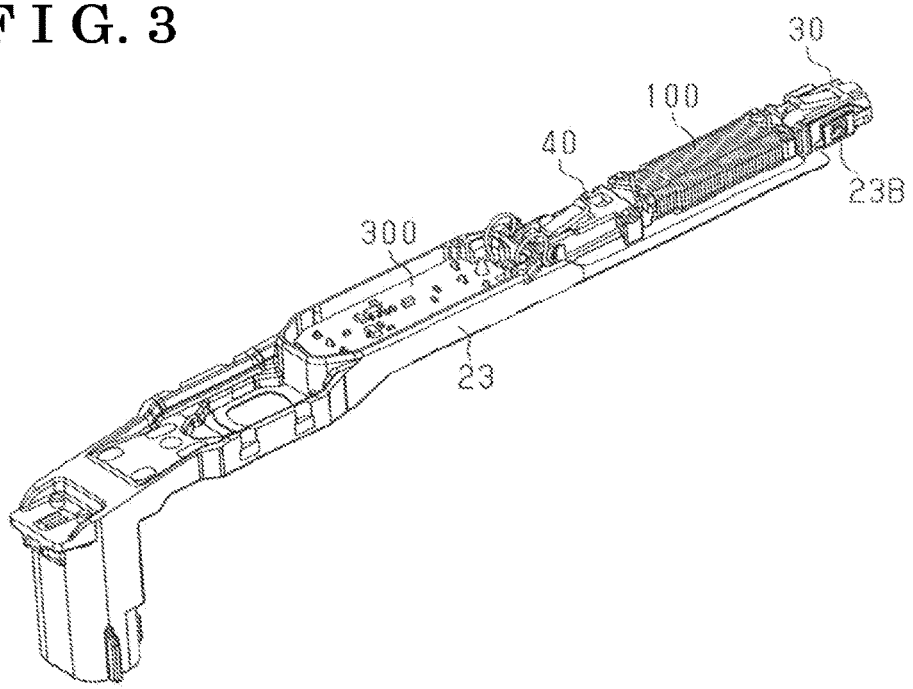
FIG. 3 is a perspective view of the door handle in a state where an inner case shown in FIG. 2 is removed.

A structure of the handle body 20 will be explained with reference to FIGS. 2 and 3. The handle body 20 includes an inner case 21 and an exterior case 22 (see FIG. 1) that are combined with each other. The bar antenna 30 and an intermediate case 23 are mounted on an inner space of the inner case 21. The intermediate case 23 is fixed with a circuit board 300 that controls signals transmitted by the bar antenna 30.

The bar antenna 30 serves as a transmission antenna transmitting signals to a mobile device that is possessed by a user, for example. The bar antenna 30 includes a stick-shaped core 200 (see FIG. 4), a bobbin 40 and a conductive wire 100. The bobbin 40 supports the core 200. The conductive wire 100 is coated and is wound around the core 200.

Figure 4:
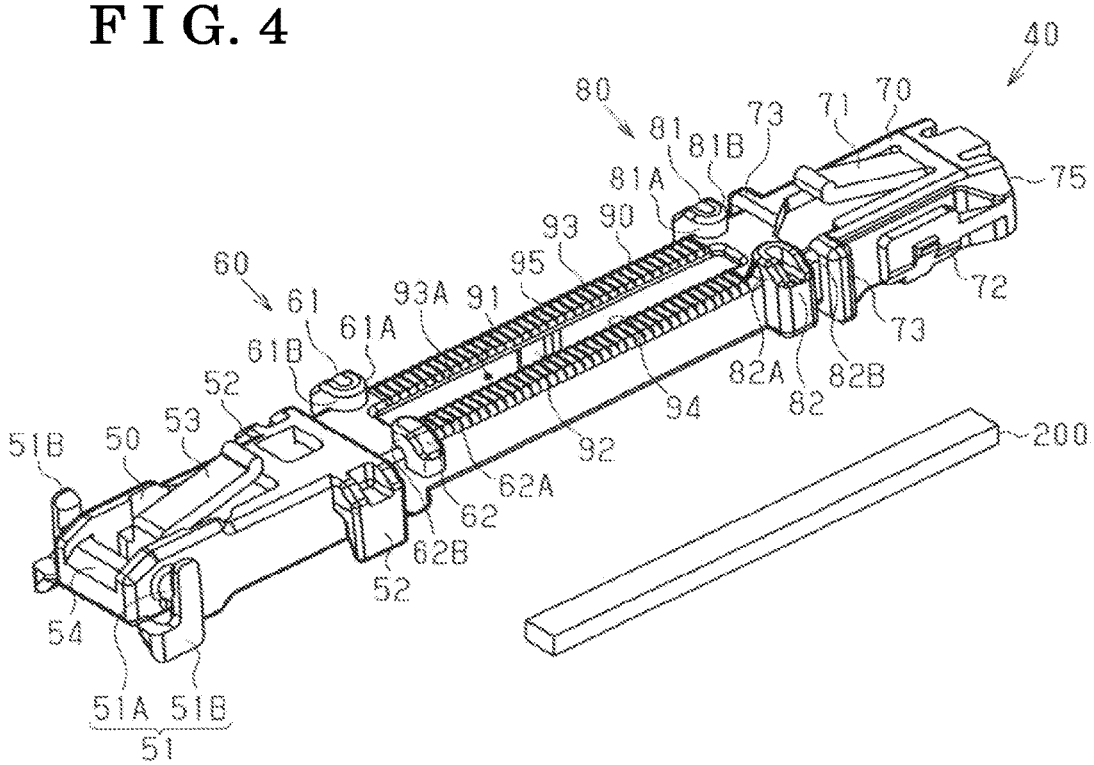
FIG. 4 is a perspective view of a front side of a bobbin according to the embodiment.

A structure of the bobbin 40 will be explained with reference to FIGS. 4 and 5. As shown in FIG. 4, the bobbin 40 includes a first core holding portion 50 (i.e., serving as a core holding portion), a second core holding portion 70 (i.e., serving as a core holding portion) and a core housing portion 90. The first core holding portion 50 is mounted with a first end portion of the core 200. The second core holding portion 70 is mounted with a second end portion of the core 200. The core housing portion 90 contains the core 200. The first and second core holding portions 50, 70 and the core housing portion 90 are integrally formed.

A pair of wound portions 51 is formed at respective side surfaces of the first core holding portion 50. The pair of wound portions 51 fixes the conductive wire 100 by being wound therewith. The wound portion 51 includes a shaft 51A and a wall 51B. The shaft 51A protrudes from the side surface of the first core holding portion 50. The wall 51B extends in a direction of a height direction, or a lateral direction of the first core holding portion 50.

A pair of pawls 52 is provided at portions closer to the core housing portion 90 relative to the wound portion 51, the portions of the side surfaces of the first core holding portion 50. The pawl 52 and the side surface of the first core holding portion 50 sandwich the conductive wire 100.

A first end of a pair of restriction portions 60 is connected to the first core holding portion 50. A second end of the pair of restriction portions 60 is connected to the core housing portion 90. The pair of the restriction portions 60, that is, a first restriction portion 61 and a second restriction portion 62, is arranged to be spaced apart from each other in a transverse direction of the bobbin 40.

The first restriction portion 61 upwardly protrudes from an upper surface of the first core holding portion 50. The first restriction portion 61 includes a first lamination side surface 61A and a first restriction surface 61B. The first lamination side surface 61A serves as a surface facing the core housing portion 90. The first restriction surface 61B serves as a surface that is positioned opposite to the first lamination side surface 61A in the longitudinal direction of the bobbin 40.

A second restriction portion 62 upwardly protrudes from the upper surface of the first core holding portion 50. The second restriction portion 62 includes a second lamination side surface 62A and a second restriction surface 62B. The second lamination side surface 62A serves as the surface facing the core housing portion 90. The second restriction surface 62B serves as a surface that is positioned opposite to the second lamination side surface 62A in the longitudinal direction of the bobbin 40.

The first lamination side surface 61A is dislocated from the second lamination side surface 62A in the longitudinal direction of the bobbin 40. The first lamination side surface 61A is positioned closer to the second core holding portion 70 relative to the second lamination side surface 62A in the longitudinal direction of the bobbin 40. The first and second restriction surfaces 61B, 62B restrict the conductive wire 100 from moving to a side where the core housing portion 90 is positioned.

A plate spring 53 is provided at the upper surface of the first core holding portion 50. The plate spring 53 biases the exterior case 22 (see FIG. 1) to a direction away from the bobbin 40 by coming in contact with the exterior case 22.

Figure 6:
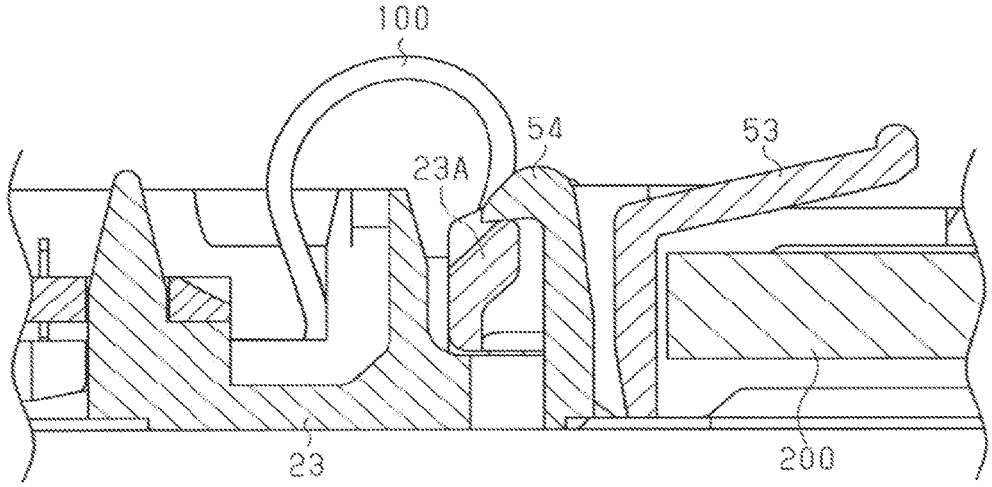
FIG. 6 is a cross sectional view taken along a line VI-VI in FIG. 2.

A case mounting pawl 54 is provided at an end portion of the first core holding portion 50 that configures a first end portion of the bobbin 40. The case mounting pawl 54 fixes the position of the bobbin 40 relative to the intermediate case 23 by being retained with a pawl 23A of the intermediate case 23 shown in FIG. 6.

Figure 5:
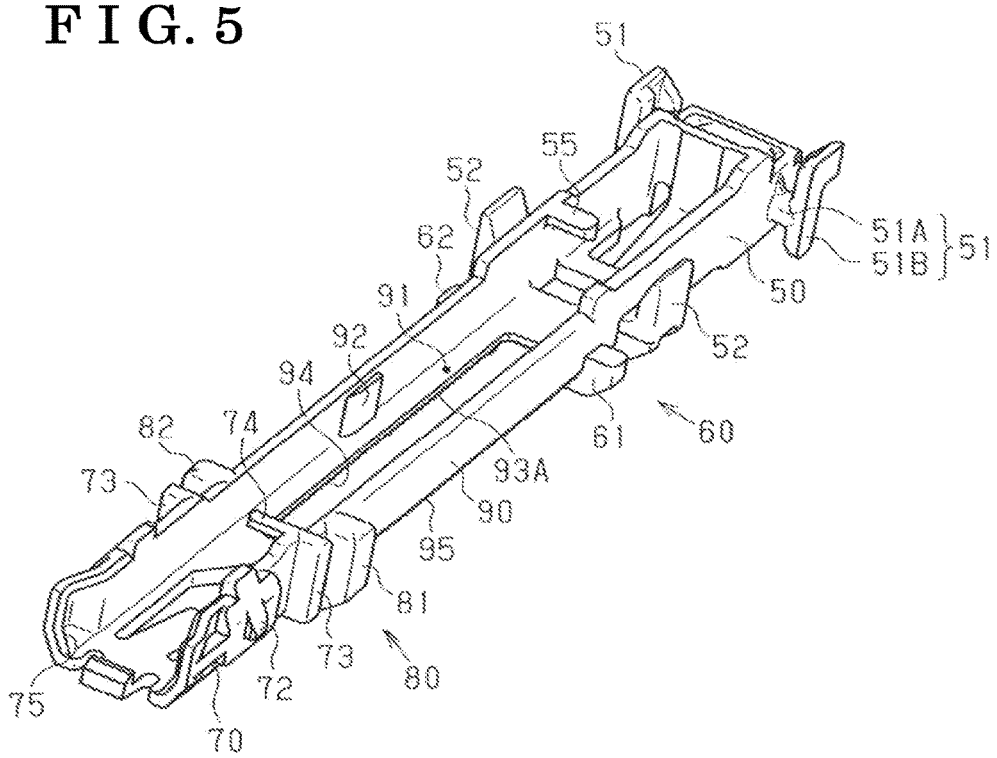
FIG. 5 is a perspective view of a back side of the bobbin according to the embodiment.

As shown in FIG. 5, a protrusion wall 55 is provided at an inner surface of the first core holding portion 50. The protrusion wall 55 defines the position of the core 200 in the longitudinal direction of the bobbin 40. As shown in FIG. 4, a first end of a pair of restriction portions 80 is connected to the first core holding portion 50. A second end of the pair of restriction portions 80 is connected to the core housing portion 90. The pair of restriction portions 80, that is, a first restriction portion 81 and a second restriction portion 82, is arranged to be spaced apart from each other in the transverse direction of the bobbin 40.

The first restriction portion 81 protrudes from a peripheral surface of the second core holding portion 70. The first restriction portion 81 includes a first lamination side surface 81A and a first restriction surface 81B. The first lamination side surface 81A serves as the surface facing the core housing portion 90. The first restriction surface 81B serves as a surface that is positioned opposite to the first lamination side surface 81A in the longitudinal direction of the bobbin 40.

The second restriction portion 82 protrudes from the peripheral surface of the second core holding portion 70. The second restriction portion 82 includes a second lamination side surface 82A and a second restriction surface 82B. The second lamination side surface 82A serves as the surface facing the core housing portion 90. The second restriction surface 82B serves as a surface that is positioned opposite to the second lamination side surface 82A in the longitudinal direction of the bobbin 40.

The first lamination side surface 81A is dislocated from the second lamination side surface 82A in the longitudinal direction of the bobbin 40. The second lamination side surface 82A is positioned closer to the first core holding portion 50 relative to the first lamination side surface 81A in the longitudinal direction of the bobbin 40. The first and second restriction surfaces 81B, 82B restrict the conductive wire 100 from moving to a side where the core housing portion 90 is positioned.

A plate spring 71 is provided at an upper surface of the second core holding portion 70. The plate spring 71 biases the exterior case 22 (see FIG. 1) to the direction away from the bobbin 40 by coming in contact with the exterior case 22.

A pair of case mounting pawls 72 is provided at respective side surfaces of the second core holding portion 70. The pair of case mounting pawls 72 is engaged with a pair of openings 23B (see FIG. 3) that is provided at the intermediate case 23. A pair of walls 73 of respective side surfaces of the second core holding portion 70, the pair of walls 73 protruding from the side surfaces of the second core holding portion 70, is provided at portions between the restriction portion 80 and the pair of case mounting pawls 72.

As shown in FIG. 5, a support wall 74 supporting the core 200 is provided at an inner surface of the second core holding portion 70. A core slot 75 into which the core 200 is inserted is provided at an end portion of the second core holding portion 70 that configures a second end portion of the bobbin 40.

As shown in FIG. 4, the core housing portion 90 is provided at a portion between the first core holding portion 50 and the second core holding portion 70. The core housing portion 90 serves as a hollow-shaped portion, a bottom surface of which is opened. The core housing portion 90 contains the core 200 in a (an inner) space 91. A pair of protrusion walls 92 is provided at respective inner surfaces of the core housing portion 90. The pair of protrusion walls 92 inhibits the core 200 from backlashing at the space 91. A long hole 94 extending in the longitudinal direction of the core housing portion 90 is provided at an upper wall 93 of the core housing portion 90. An upper surface 93A of the core housing portion 90 is provided with plural grooves 95 along a winding direction of the conductive wire 100.

Figure 7:
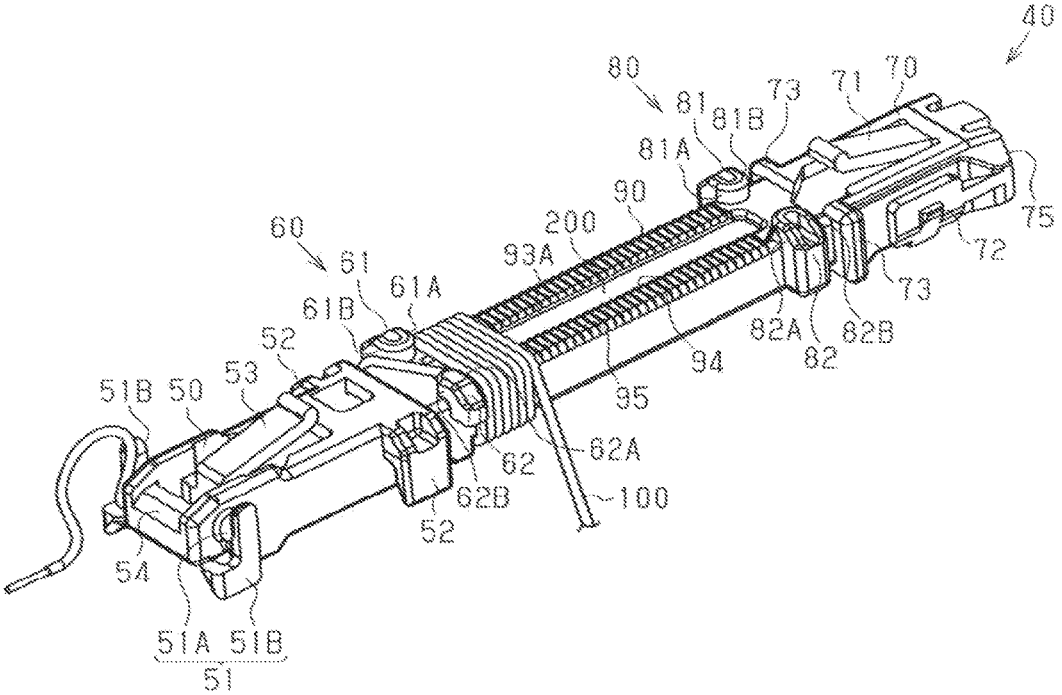
FIG. 7 is a perspective view of the bobbin when a conductive wire is wound around the bobbin of the embodiment.

An operation of the bar antenna 30 will be explained with reference to FIGS. 7 to 10. The bar antenna 30 is manufactured by a following procedure, for example. As shown in FIG. 7, the core 200 is inserted from the core slot 75 of the second core holding portion 70 (see FIG. 5) and is positioned at the space 91 of the core housing portion 90. The conductive wire 100 is wound around the shaft 51A of the wound portion 51, for example. The pawl 52 and the side surface of the first core holding portion 50 sandwich the conductive wire 100. The conductive wire 100 passes through a portion between the first restriction portion 61 and the second restriction portion 62 to be positioned at the upper surface 93A of the core housing portion 90.

The conductive wire 100 is wound around the core housing portion 90 in a first direction, that is, from a side where the first core holding portion 50 is positioned to a side where the second core holding portion 70 is positioned, along the grooves 95 being formed on the upper surface 93A. Accordingly, the winding of a first layer of the conductive wire 100 around the core housing portion 90 is completed.

Figure 8:
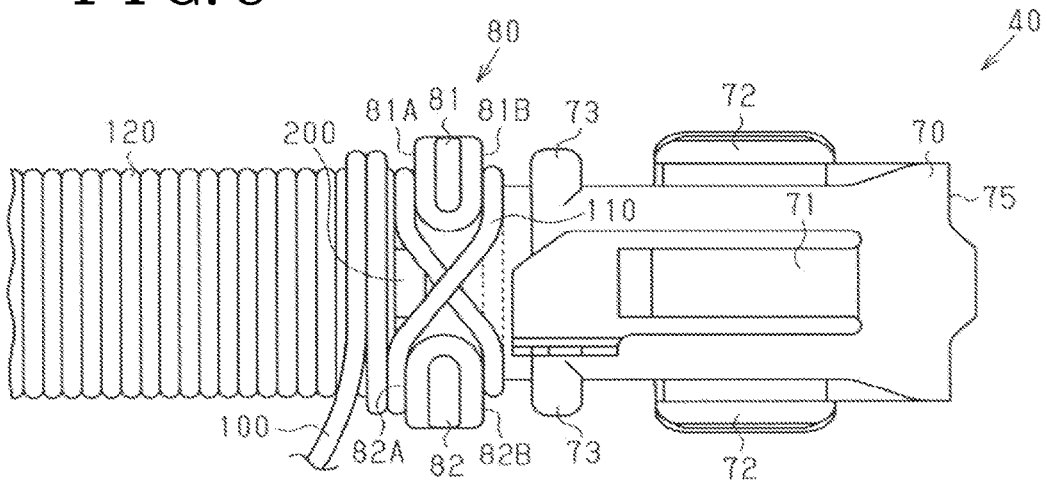
FIG. 8 is a plan view of a second core holding portion of the bobbin and surroundings of the second core holding portion of the embodiment.

As shown in FIG. 8, the conductive wire 100 reaching the first restriction portion 81 being connected to the second core holding portion 70 comes in contact with the first lamination side surface 81A being connected to the second core holding portion 70. A distal end of the conductive wire 100 passes through a portion between the first restriction portion 81 and the second restriction portion 82. The conductive wire 100 that passes through the portion between the first and second restriction portions 81, 82 is wound at a portion of the peripheral surface of the second core holding portion 70, the portion positioned between the restriction portion 80 and the wall 73. The conductive wire 100 is turned back towards the core housing portion 90 at the first restriction surface 81B to form a turned-back portion 110. The distal end of the conductive wire 100 being formed with the turned-back portion 110 passes through the portion between the first restriction portion 81 and the second restriction portion 82. Thus, the conductive wire 100 intersects a portion of the conductive wire 100 that is previously wound between the first and second restriction portions 81, 82. The conductive wire 100 that passes through the first and second restriction portions 81, 82 comes in contact with the second lamination side surface 82A and is wound and laminated on a lamination portion 120 of the first layer of the conductive wire 100 in a second direction, that is, from the side where the second core holding portion 70 is positioned to the side where the first core holding portion 50 is positioned.

Figure 9:
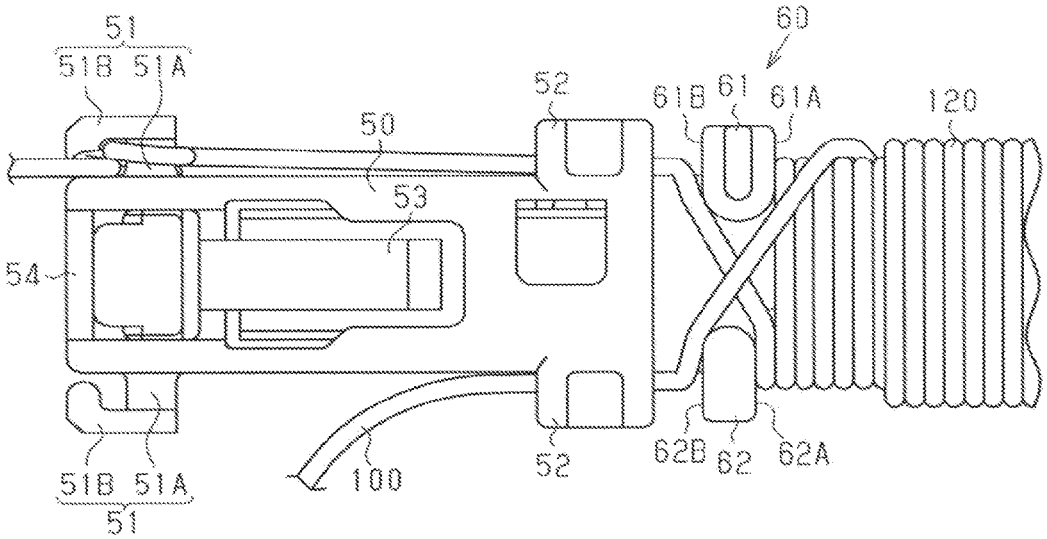
FIG. 9 is a plan view of a first core holding portion of the bobbin and surroundings of the first core holding portion of the embodiment.

As shown in FIG. 9, a second layer of the conductive wire 100 comes in contact with the first lamination side surface 61A and passes through the portion between the first restriction portion 61 and the second restriction portion 62. Thus, the conductive wire 100 intersects a portion of the conductive wire 100 that is previously wound between the first restriction portion 61 and the second restriction portion 62.

Figure 10:
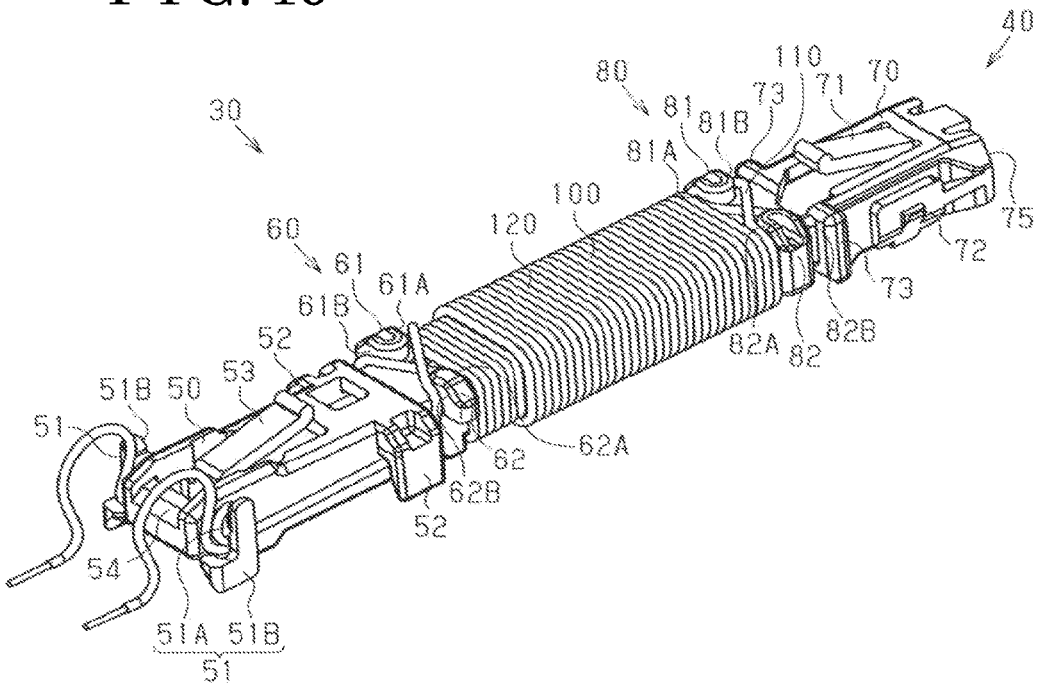
FIG. 10 is a perspective view of a bar antenna of the embodiment.

As shown in FIG. 10, the conductive wire 100 that passes through the portion between the first restriction portion 61 and the second restriction portion 62 passes through the pawls 52 and is wound around the shaft 51A of the wound portion 51, for example. Accordingly, the bar antenna 30 is completed.

According to the bobbin 40 of the embodiment, following effects and advantages may be attained.

According to the bobbin 40 of the embodiment, the conductive wire 100 is wound around the core 200 being mounted to the second core holding portion 70 to form the lamination portion 120 of the first layer of the conductive wire 100. The turned-back portion 110 of the conductive wire 100 being formed at the end portion of the lamination portion 120 of the first layer of the conductive wire 100 is restricted from moving to the side where the lamination portion 120 of the first layer of the conductive wire 100 is positioned by the restriction portion 80. Thus, an irregular shape of winding of the conductive wire 100 is less likely to occur at the turned-back portion 110. As such, according to the bobbin 40 of the embodiment, because the irregular shape of winding of the conductive wire 100 is inhibited at the turned-back portion 110, the second layer of the conductive wire 100 may be securely wound on the first layer of the lamination portion 120. Because the second layer of the conductive wire 100 is laminated on the lamination portion 120 of the first layer of the conductive wire 100, the inductance desired to a coil is secured even if the length of the core 200 is set short.

Because the first and second restriction portions 81, 82 are arranged to be spaced apart from each other in the transverse direction of the core 200, the conductive wire 100 may pass through the portion between the first restriction portion 81 and the second restriction portion 82. Thus, comparing to a case where the conduction wire 100 runs on the restriction portion 80 and is wound between a side where the lamination portion 120 is positioned and the side where the second core holding portion 70 is positioned, the conductive wire 100 less likely generates a protrusion at the bobbin 40, the protrusion protruding from the bobbin 40 being formed with the coil. Thus, the bar antenna 30 may be downsized.

Because the restriction portion 80 of the bobbin 40 includes the first restriction surface 81B and the second restriction surface 82B, comparing to a case where, for example, the restriction portion 80 is formed in a cylindrical protrusion, the contact areas of the first and second restriction surfaces 81B, 82B relative to the turned-back portion 110 of the conductive wire 100 come to be increased. Thus, the turned-back portion 110 is further inhibited from moving relative to the bobbin 40.

The second lamination side surface 82A is positioned closer to the first core holding portion 50 relative to the first lamination side surface 81A in the longitudinal direction of the bobbin 40. That is, the second lamination side surface 82A is positioned close to a center portion in the longitudinal direction of the bobbin 40. Thus, because the conductive wire 100 that is wound from the side where the second core holding portion 70 is positioned to the side where the lamination portion 120 is positioned comes in contact with the second lamination side surface 82A, a start position for winding the second layer of the conductive wire 100 can be defined. At this time, because the second lamination side surface 82A being positioned close to the center portion in the longitudinal direction of the first layer of the conductive wire 100 and the conductive wire 100 come in contact with each other, the starting position of winding of the second layer of the conductive wire 100 may be set closer to the center portion in the longitudinal direction of the bobbin 40 relative to the end portion of the first layer of the conductive wire 100. Because the starting position of winding of the second layer of the conductive wire 100 may be from a dent, or a recess of the first layer of the conductive wire 100, the dent being formed between portions of the conductive wire 100, the second layer of the conductive wire 100 is easily wound.

The core 200 being mounted with the bobbin 40 is protected at the core housing portion 90. Thus, the core 200 is less likely damaged. Because the restriction portion 80 is provided at the second core holding portion 70, the length of the bobbin 40 in the longitudinal direction is easily set short.

According to the bobbin 40, because the conductive wire 100 is wound around the core housing portion 90 while being fitted into the grooves 95, the position of the conductive wire 100 is less likely dislocated when forming the first layer of the conductive wire 100. Accordingly, the first layer of the conductive wire 100 is easily wound.

According to the bar antenna 30 of the embodiment, because the length of the core 200 is set short, the length of the bar antenna 30 can be set short. Because the irregular shape of winding of the conductive wire 100 at the turned-back portion 110 is less likely to occur, the performance of the bar antenna 30 may be inhibited from being degraded due to the downsizing of the bar antenna 30.

The aforementioned embodiment may be modified as follows. The modified examples may be combined with each other as appropriate unless any technical contradiction occurs.

At least one of the first core holding portion 50 and the core housing portion 90 may not be provided.

The first and second restriction portions 81, 82 may be continuously or integrally formed in the transverse direction of the core 200. In this case, it is favorable that the first and second restriction portions 81, 82 include a hole or a recess through which the conductive wire 100 passes.

The first lamination side surface 81A and the second lamination side surface 82A may be formed at the same position in the longitudinal direction of the core 200.

The first lamination side surface 61A and the second lamination side surface 62A may be formed at the same position in the longitudinal direction of the core 200.

The core housing portion 90 may be formed in a tubular shape.

At least one of the long hole 94 and the grooves 95 may not be provided at the core housing portion 90.

The first and second restriction portions 81, 82 may be provided at the core housing portion 90.

The first and second restriction portions 61, 62 may be provided at the core housing portion 90.

The bar antenna 30 is applicable as a reception antenna or as a transmission antenna.

The bar antenna 30 may be mounted to any member, for example, to a door mirror or to a room mirror of the vehicle 1.

According to the aforementioned embodiment, the bobbin (40) for the bar antenna (30) includes the core holding portion (50, 70) being configured to be mounted with the stick-shaped core (200), and the restriction portion (60, 80) being connected to the core holding portion (50, 70), the restriction portion (60, 80) being configured to restrict the turned-back portion (110) of the conductive wire (100) from moving to the side where a lamination portion (120) is positioned, the conductive wire (100) forming the lamination portion (120) by being wound to the core (200) in the first direction in the longitudinal direction of the core (200), the turned-back portion (110) serving as a portion being turned back in the second direction that is different from the first direction.

According to the bobbin 40 for the bar antenna 30, the first layer of the conductive wire 100 is wound around the core 200 being mounted to the second core holding portion 70. The turned-back portion 110 is formed at the end portion of the first layer of the conductive wire 100. The second layer of the conductive wire 100 may be wound on the first layer of the conductive wire 100. Accordingly, the inductance of the coil is secured even if the length of the core 200 is set short. The turned-back portion 110 is restricted from moving to the side where lamination portion 120 of the conductive wire 100 is positioned by the restriction portion 80, the lamination portion 120 serving as a portion where the first layer and the second layer are laminated. Thus, the irregular shape of winding of the conductive wire 100 is less likely to occur at the turned-back portion 110.

According to the aforementioned embodiment, the restriction portion (60, 80) includes the first restriction portion (61, 81) and the second restriction portion (62, 82). The first restriction portion (61, 81) and the second restriction portion (62, 82) are arranged to be spaced apart from each other in the transverse direction of the core (200).

According to the bobbin 40 of the bar antenna 30, the end portion of the conductive wire 100 passes through the portion between the first and second restriction portions 81, 82 after the first layer of the conductive wire 100 is wound around the core 200. Accordingly, the end portion of the conductive wire 100 is wound from the side where the lamination portion 120 is positioned to a side where the second core holding portion 70 is positioned relative to the restriction portion 80, the side opposite to the side where the lamination portion 120 is positioned. The conductive wire 100 being wound to the side where the second core holding portion 70 is positioned is wound to, for example, the core 200 or the first core holding portion 50. The distal end of the conductive wire 100 passes through the portion between the first and second restriction portions 81, 82. Accordingly, the distal end of the conductive wire 100 is wound from the side where the second core holding portion 70 is positioned to the side where the lamination portion 120 is positioned. Thus, the second layer of the conductive wire 100 is wound on the first layer of the conductive wire 100. Accordingly, comparing to a case where the conduction wire 100 runs on the restriction portion 80 and is wound between the side where the lamination portion 120 is positioned and the side where the second core holding portion 70 is positioned, the conductive wire 100 less likely generates the protrusion at the bobbin 40, the protrusion protruding from the bobbin 40 being formed with the coil. Thus, the bar antenna 30 may be downsized.

According to the aforementioned embodiment, the first restriction portion (61, 81) serving as the first restriction portion (61, 81) of the restriction portion (60, 80) includes the first lamination side surface (61A, 81A) serving as the surface being formed at the side where the lamination portion (120) is positioned. The first restriction portion (61, 81) includes the first restriction surface (61B, 81B) serving as the surface being positioned opposite to the first lamination side surface (61A, 81A) in the longitudinal direction of the core (200). The second restriction portion (62, 82) serving as the second restriction portion (62, 82) of the restriction portion (60, 80) includes the second lamination side surface (62A, 82A) serving as the surface being formed at the side where the lamination portion (120) is positioned. The second restriction portion (62, 82) includes the second restriction surface (62B, 82B) serving as the surface being positioned opposite to the second lamination side surface (62A, 82A) in the longitudinal direction of the core (200).

According to the restriction portion 80 of the bobbin 40 of the bar antenna 30, comparing to a case where, for example, the restriction portion 80 is formed in the cylindrical protrusion, the contact areas of the restriction surfaces 81B, 82B relative to the turned-back portion 110 of the conductive wire 100 come to be increased. Thus, the turned-back portion 110 is further inhibited from moving to the side where the lamination portion 120 is positioned relative to the bobbin 40.

According to the aforementioned embodiment, the first lamination side surface (61A, 81A) and the second lamination side surface (62A, 82A) are dislocated from each other in the longitudinal direction of the core (200).

According to the bobbin 40 of the bar antenna 30, because the conductive wire 100 that is wound from the side where the second core holding portion 70 is positioned to the side where the lamination portion 120 is positioned comes in contact with one of the first lamination side surface 81A and the second lamination surface 82A, the starting position for winding the second layer of the conductive wire 100 can be defined. At this time, because one of the first lamination side surface 81A and the second lamination surface 82A being positioned close to the center portion in the longitudinal direction of the first layer of the conductive wire 100 and the conductive wire 100 come in contact with each other, the starting position of winding of the second layer of the conductive wire 100 may be set closer to the center portion in the longitudinal direction of the bobbin 40 relative to the end portion of the first layer of the conductive wire 100. Because the starting position of winding of the second layer of the conductive wire 100 may be from the dent, or the recess of the first layer of the conductive wire 100, the dent being formed between the portions of the conductive wire 100, the second layer of the conductive wire 100 is easily wound.

According to the aforementioned embodiment, the bobbin (40) for the bar antenna (30) further includes the core housing portion (90) being formed with the space that is configured to contain the core (200). The core holding portion (50, 70) is connected to the end portion of the core housing portion (90) in the longitudinal direction of the core (200). The restriction portion (60, 80) is formed at one of the core housing portion (90) and the core holding portion (50, 70).

The core 200 being mounted with the bobbin 40 of the bar antenna 30 is protected at the core housing portion 90. Thus, the core 200 is less likely damaged. Because the restriction portion 80 is provided at one of the core housing portion 90 and the core holding portion 50, 70, the length of the bobbin 40 in the longitudinal direction is easily set short.

According to the aforementioned embodiment, the core housing portion (90) is formed with the plural grooves (95) being positioned along the winding direction of the conductive wire (100).

According to the bobbin 40, because the conductive wire 100 is wound around the core housing portion 90 while being fitted into the grooves 95, the position of the conductive wire 100 is less likely dislocated when the first layer of the conductive wire 100 is wound. Accordingly, the first layer of the conductive wire 100 is easily wound.

According to the aforementioned embodiment, the first lamination side surface (61A, 81A) and the second lamination side surface (62A, 82A) are dislocated from each other by a length that is different from a diameter of the conductive wire (100) in the longitudinal direction of the core (200).

According to the bobbin 40 of the bar antenna 30, because the conductive wire 100 that is wound from the side where the second core holding portion 70 is positioned to the side where the lamination portion 120 is positioned comes in contact with one of the first lamination side surface 81A and the second lamination surface 82A, the starting position for winding the second layer of the conductive wire 100 can be defined. At this time, because one of the first lamination side surface 81A and the second lamination surface 82A being positioned close to the center portion in the longitudinal direction of the first layer of the conductive wire 100 and the conductive wire 100 come in contact with each other, the starting position of winding of the second layer of the conductive wire 100 may be set closer to the center portion in the longitudinal direction of the bobbin 40 relative to the end portion of the first layer of the conductive wire 100. Because the starting position of winding of the second layer of the conductive wire 100 may be from the dent, or the recess of the first layer of the conductive wire 100, the dent being formed between the portions of the conductive wire 100, the second layer of the conductive wire 100 is easily wound.

According to the aforementioned embodiment, the first lamination side surface (61A, 81A) and the second lamination side surface (62A, 82A) are dislocated from each other by a length that is a half of the diameter of the conductive wire (100) in the longitudinal direction of the core (200).

According to the bobbin 40 of the bar antenna 30, because the conductive wire 100 that is wound from the side where the second core holding portion 70 is positioned to the side where the lamination portion 120 is positioned comes in contact with one of the first lamination side surface 81A and the second lamination surface 82A, the starting position for winding the second layer of the conductive wire 100 can be defined. At this time, because one of the first lamination side surface 81A and the second lamination surface 82A being positioned close to the center portion in the longitudinal direction of the first layer of the conductive wire 100 and the conductive wire 100 come in contact with each other, the starting position of winding of the second layer of the conductive wire 100 may be set closer to the center portion in the longitudinal direction of the bobbin 40 relative to the end portion of the first layer of the conductive wire 100. Because the starting position of winding of the second layer of the conductive wire 100 may be from the dent, or the recess of the first layer of the conductive wire 100, the dent being formed between the portions of the conductive wire 100, the second layer of the conductive wire 100 is easily wound.

According to the aforementioned embodiment, the bar antenna (30) includes the stick-shaped core (200), the conductive wire (100) being wound around the core (100), and the bobbin (40) of the bar antenna (30) including the core holding portion (50, 70) being mounted with the core (200), and the restriction portion (60, 80) being connected to the core holding portion (50, 70), the restriction portion (60, 80) restricting the turned-back portion (110) of the conductive wire (100) from moving to the side where the lamination portion (120) is positioned, the conductive wire (100) forming the lamination portion (120) by being wound to the core (200) in the first direction in the longitudinal direction of the core (200), the turned-back portion (110) serving as the portion being turned back in the second direction that is different from the first direction.

According to the bar antenna 30 of the embodiment, because the length of the core 200 is set short, the length of the bar antenna 30 can be set short. Because the irregular shape of winding of the conductive wire 100 at the turned-back portion 110 is less likely to occur, the performance of the bar antenna 30 may be inhibited from being degraded due to the downsizing of the bar antenna 30.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A bobbin for a bar antenna, comprising:

a core holding portion being configured to be mounted with a stick-shaped core;

a conductive wire including a first layer and a second layer; and a restriction portion being connected to the core holding portion, the restriction portion being configured to restrict a turned-back portion of the conductive wire from moving to a side where a lamination portion is positioned, the conductive wire forming the lamination portion by being wound to the core in a first direction in a longitudinal direction of the core, wherein the turned-back portion is a portion of the conductive wire being turned back in a second direction that is different from the first direction so that the second layer of the conductive wire is wound on the first layer of the conductive wire;

the restriction portion includes a first restriction portion and a second restriction portion;

the first restriction portion and the second restriction portion are arranged to be spaced apart from each other in a transverse direction of the core;

the first restriction portion includes a first lamination side surface serving as a surface being formed at the side where the lamination portion is positioned, the first restriction portion includes a first restriction surface serving as a surface being positioned opposite to the first lamination side surface in the longitudinal direction of the core;

the second restriction portion includes a second lamination side surface serving as a surface being formed at the side where the lamination portion is positioned, the second restriction portion includes a second restriction surface serving as a surface being positioned opposite to the second lamination side surface in the longitudinal direction of the core; and the first lamination side surface and the second lamination side surface are dislocated from each other by a length that is a half of the diameter of the conductive wire in the longitudinal direction of the core.

2. The bobbin for the bar antenna according to claim 1, further comprising:

a core housing portion being formed with a space that is configured to contain the core; wherein the core holding portion is connected to an end portion of the core housing portion in the longitudinal direction of the core; and the restriction portion is formed at one of the core housing portion and the core holding portion.

3. The bobbin for the bar antenna according to claim 2, wherein the core housing portion is formed with a plurality of grooves being positioned along a winding direction of the conductive wire.

4. A bar antenna, comprising:

a stick-shaped core;

a conductive wire being wound around the core, the conductive wire including a first layer and a second layer; and a bobbin of the bar antenna including:

a core holding portion being mounted with the core; and a restriction portion being connected to the core holding portion, the restriction portion restricting a turned-back portion of the conductive wire from moving to a side where a lamination portion is positioned, the conductive wire forming the lamination portion by being wound to the core in a first direction in a longitudinal direction of the core, wherein the turned-back portion is a portion of the conductive wire being turned back in a second direction that is different from the first direction so that the second layer of the conductive wire is wound on the first layer of the conductive wire;

the restriction portion includes a first restriction portion and a second restriction portion;

the first restriction portion and the second restriction portion are arranged to be spaced apart from each other in a transverse direction of the core;

the first restriction portion includes a first lamination side surface serving as a surface being formed at the side where the lamination portion is positioned, the first restriction portion includes a first restriction surface serving as a surface being positioned opposite to the first lamination side surface in the longitudinal direction of the core;

the second restriction portion includes a second lamination side surface serving as a surface being formed at the side where the lamination portion is positioned the second restriction portion includes a second restriction surface serving as a surface being positioned opposite to the second lamination side surface in the longitudinal direction of the core; and the first lamination side surface and the second lamination side surface are dislocated from each other by a length that is a half of the diameter of the conductive wire in the longitudinal direction of the core.

5. The bar antenna according to claim 4, further comprising:

a core housing portion being formed with a space that contains the core; wherein the core holding portion is connected to an end portion of the core housing portion in the longitudinal direction of the core; and the restriction portion is formed at one of the core housing portion and the core holding portion.

6. The bar antenna according to claim 5, wherein the core housing portion is formed with a plurality of grooves being positioned along a winding direction of the conductive wire.

* * * * *